US005605268A

United States Patent [19]

Hayashi et al.

[11] Patent Number: 5,605,268

[45] Date of Patent: Feb. 25, 1997

[54] PORTABLE MOTOR-DRIVEN STAPLE MACHINE

[75] Inventors: Susumu Hayashi; Hitoshi Matsumoto, both of Tokyo, Japan

[73] Assignee: Max Co., Ltd., Tokyo, Japan

[21] Appl. No.: 353,316

[22] Filed: Dec. 5, 1994

[30] Foreign Application Priority Data

Dec. 6, 1993 [JP] Japan ..... 5-065102

[51] Int. Cl.[6] ..... B25C 5/15

[52] U.S. Cl. ..... 227/8; 227/131

[58] Field of Search ..... 227/7, 8, 131

[56] References Cited

U.S. PATENT DOCUMENTS

| | | | |
|---|---|---|---|
| 4,005,812 | 2/1977 | Doyle et al. | 227/131 |
| 4,033,500 | 7/1977 | Manganaro | 227/131 |
| 4,108,345 | 8/1978 | Manganaro . | |
| 4,183,453 | 1/1980 | Barrett et al. . | |
| 4,298,072 | 11/1981 | Baker et al. | 227/131 |
| 4,724,992 | 2/1988 | Ohmori . | |
| 4,940,177 | 7/1990 | Jimena | 227/7 |
| 5,118,023 | 6/1992 | Fushiya et al. | 227/8 |

FOREIGN PATENT DOCUMENTS

| | | |
|---|---|---|
| 0226027 | 6/1987 | European Pat. Off. . |
| 1526532 | 9/1978 | United Kingdom . |

*Primary Examiner*—Scott A. Smith
*Attorney, Agent, or Firm*—Cushman Darby & Cushman, IP Group of Pillsbury Madison & Sutro, LLP

[57] ABSTRACT

A portable motor-driven staple machine comprises: a trigger operation detecting switch 5 which is turned on and off by a trigger lever 3; a contact detecting switch 25 which is turned on and off by a contact arm 23; a cycle completion detecting switch 21 which is turned on and off by a plunger 17; and a mode change-over switch for selecting a single cycle operation mode or a continuous operation mode. Those switches are connected to a control circuit 26. When the trigger lever 3 is operated with the contact detecting switch 25 in "off" state, a timer section in the control circuit 26 counts clock pulses so that when it is detected that a predetermined period of time has passed, the switch "on" signal of the trigger operation detecting switch 5 is cut off. In the case where the continuous operation mode is selected, an automatic power interrupting function is released, so that the motor 7 is continuously driven; that is, staples are continuously driven into the object until the trigger operation detecting switch 5 or the contact detecting switch 25 is turned off.

4 Claims, 3 Drawing Sheets

PORTABLE MOTOR-DRIVEN STAPLE MACHINE

BACKGROUND OF THE INVENTION

1. Field of Invention

This invention relates to motor-driven staple machines, and more particularly to a portable motor-driven staple machine used for joining building materials.

2. Description of Prior Art

A conventional motor-driven staple machine used for interior finishing work of buildings or the like is designed as follows: The elastic force of a spring is utilized to cause a staple driver to drive staples into a given object. The staple driver is coupled to a plunger. A compression spring is engaged with the plunger to urge the latter in the staple discharge direction. The plunger is raised through a cam mechanism by an electric motor, and the cam is disengaged from the plunger near the top dead center. As a result, the staple drive is abruptly moved downwardly by the elastic force of the compression spring, to drive the staple into the object such as a building material.

The motor has a start switch mechanism which is such that the trigger lever and the contact-detecting contact arm provided near the staple shot outlet form a mechanical AND mechanism for preventing staples from being carelessly discharged, and an automatic switch interrupting mechanism using a cam is provided to interrupt the application of power every operation cycle. In other words, the contact arm is pushed inwardly by abutting the shot outlet of the staple machine against the object, and the trigger lever is pulled to start the motor to cause the staple driver to drive a staple into the object. Thereafter, the plunger is raised to the standby position near the top dead center, and the power switch is turned off by the cam mechanism. Thus, the one operation cycle has been accomplished. The above-described staple driving operation is carried out repeatedly to drive a number of staples into the object or objects.

In the conventional motor-driven staple machine, the trigger lever and the contact arm form the mechanical AND mechanism, as described above. Hence, when only the trigger lever is operated, the motor is not started; that is, in order to discharge the staple, it is necessary to perform two different operations; i.e., to push the staple machine against a given object and then to operate the trigger lever. This is to prevent the accident that staples are carelessly discharged. However, for instance when the staple machine is moved by the operator, the following accident may occur: That is, with the trigger lever pulled, the contact arm may be set on a human body or the like. In this case, the motor is started to discharge the staple to cause bodily injury.

With the staple machine, the power is interrupted every operation cycle to suspend the staple driving operation; that is, it is necessary to operate the trigger lever for every staple. Therefore, when it is required to drive a number of staples continuously, it is rather troublesome to operate the trigger lever for every staple.

Thus, it is necessary to eliminate the above-described difficulty that staples may be carelessly discharged; i.e., to improve the safety of the staple machine, and to improve the operating performance of the staple machine thereby to enhance its work efficiency. However, there are technical problems which must be solved to satisfy those requirements. An object of the invention is to solve those technical problems.

SUMMARY OF THE INVETION

The foregoing object of the invention has been achieved by the provision of a portable motor-driven staple machine for driving a staple into an object of construction work or the like, the portable motor-driven staple machine comprising: a staple shot outlet; a detection section for detecting the contact of the staple shot outlet with the object; a trigger lever; an electric acturator operated to discharge the staple; one of a mechanical safety mechanism and AND circuit allowing the electric acturator to discharge the staple when the staple shot outlet contacts the object and the trigger lever is operated; timer means for starting a time measuring operation when said trigger lever is operated while the staple shot outlet is not in contact with the object; means for comparing a predetermined reference time period with a time period measured by the timer means; and means which, when the time period measured by the timer means reaches the predetermined reference time period, cuts off a switch "on" signal of the trigger lever, and resets the measured value of said timer means.

The second means is a portable motor-driven staple machine for construction work or the like which has an automatic power interrupting function of interrupting the application of power to an electric actuator after a single operation cycle, which machine, according to the invention, comprises: means for controlling the automatic power interrupting function; and a mode change-over switch for selecting a single operation cycle mode and a continuous operation mode, the automatic power interrupting function being disabled by operating the mode change-over switch.

The portable motor-driven staple machine of the present invention operates as follows: The timer means starts a time measuring operation when the trigger lever is operated while the shot outlet is not in contact with an object to be stapled. When, in this case, the timer means detects that the shot outlet is not brought into contact with the object for a predetermined reference time, for instance several seconds, the switch "on" signal of the trigger lever is cut off. Hence, the predetermined time after the operation of the trigger lever, discharging staples is suspended even if the shot outlet is brought into contact with a human body or the like.

The portable motor-driven staple machine of the invention has the mode change-over switch which selects a single cycle operation mode or a continuous operation mode. When the single cycle operation mode is selected by the change-over switch, the staple machine operates as follows: When the trigger lever is operated with the shot outlet pushed against an object to be stapled, a staple is driven into the object. And the completion of the one cycle operation is detected, so that the motor is stopped, and the staple machine is placed in standby state. When the continuous operation mode is selected, the motor is started in the same manner to drive staples; however, it should be noted that, until the trigger lever is released or the shot outlet is moved away from the object, the motor is maintained rotated, and staples are continuously discharged. Thus, although it is required to drive staples continuously, it is unnecessary to operate the trigger lever for every staple.

DETAILED DESCRIPTION OF THE PREFERRED EMBODIMENTS

One preferred embodiment of the invention will be described with reference to FIGS. 1 through 3.

Figure 1:
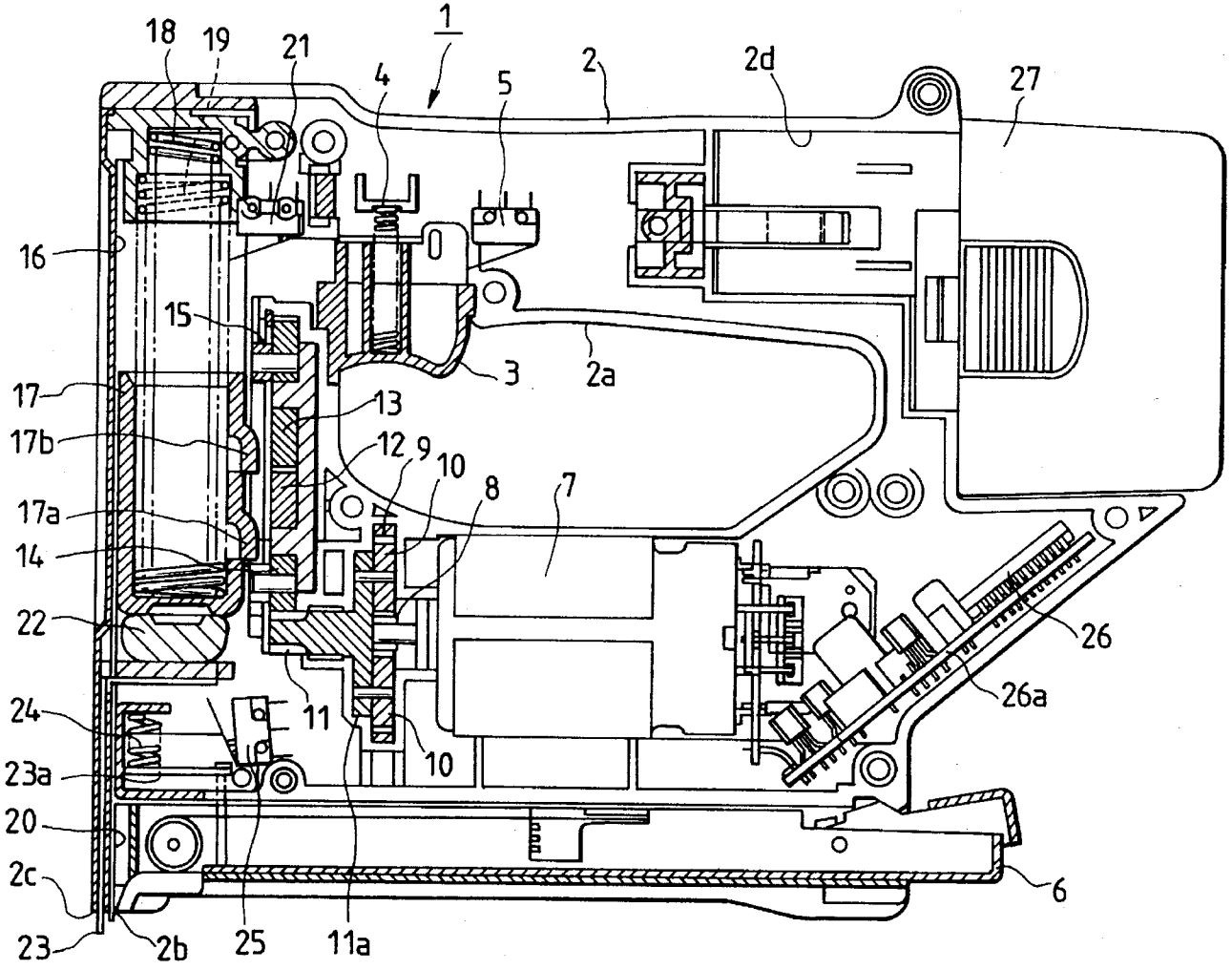
FIG. 1 is a vertical sectional side view of a portable motor-driven staple machine according to the invention.

FIG. 1 shows a portable motor-driven staple machine 1, which constitutes the embodiment of the invention. The staple machine 1 has an outer casing, namely, a die-cast frame 2. The frame 2 includes a handle 2*a* which is defined by an elongated hole formed in the central portion of the frame 2. A trigger lever 3 is provided in front of the handle 2*a*; more specifically, it is protruded in the elongated hole by a compression spring 4. The trigger lever 3 is operated with the index finger to turn on a trigger operation detecting switch 5. A staple magazine 6 is provided on the bottom of the frame 2, to accommodate a series of U-shaped staples (not shown) which are bonded to one after another in the form of an angle steel bar.

A motor 7 is arranged in the middle of the frame 2. A pinion gar 8 is mounted on the rotary shaft of the motor 7. Planet gears 10 are interposed between the pinion gear 8 of the motor 7 and an integral ring gear 9 fixed to the frame 2. The planet gears 10 are rotatably mounted through shafts on the rear disk 11*a* of an intermediate pinion gear 11. In the train of those gears, the planet gears 10 revolve. Therefore, the intermediate pinion gear 11 is turned at a speed lower than the speed of rotation of the motor 7.

A pair of spur gears 12 and 13 engaged with each other are arranged vertically above the intermediate pinion gear 11. The latter 11 is engaged with the spur gear 12, which is the lower of the pair of spur gears 12 and 13 arranged vertically. Hence, as the motor 7 rotates, the upper and lower spur gears 13 and 12 are rotated in the opposite directions. Rollers 14 and 15 are mounted through shafts on the front surfaces of the upper and lower spur gears 13 and 12 in such a manner that they are shifted from the centers of rotation of the spur gears. Therefore, as the spur gears 12 and 13 rotate, the rollers 14 and 15 are revolved.

In front of the spur gears 12 and 13, a cylinder member 16 is provided in such a manner that it is extended vertically. A plunger 17 is loosely fitted in the cylinder member 16. In addition, compression coils 18 and 19 are provided inside the cylinder member 16; more specifically, they are interposed between the top of the latter 16 and the plunger 17, to urge the latter 17 downwardly.

A plate-shaped staple driver 20 is fixedly secured to the front surface of the plunger 17. When the plunger 17 is moved downwardly, the staple driver 20 is also moved downwardly to protrude through a shot outlet 2*b* which is formed in the lower surface of the front end of the frame 2, as shown in FIG. 1. The plunger 17 has protrusions 17*a* and 17*b* in the rear surface which are extended rearwards. When the spur gears 12 and 13 rotate, first the roller 14 of the lower spur gear 12 is engaged with the lower protrusion 17*a* to move the plunger 17 upwardly near to the top dead center of the roller 14, so that the staple drive 20 is retracted inside the shot outlet 2*b*; and next the roller 15 of the upper spur gear 13 is engaged with the upper protrusion 17*b* to further move the plunger 17 upwardly.

A cycle completion detecting switch 21 is fixedly mounted on the upper portion of the cylinder member 16 so that it is operated by the plunger 17. That is, the arrival of the plunger 17 to the upper stop position is detected when the upper end of the plunger 17 pushes the cycle completion detecting switch.

As the motor 7 is further rotated, the plunger 17 is further moved upwardly but slightly, and the roller 15 of the upper spur gear 13 is therefore disengaged from the upper protrusion 17*b* of the plunger 17. As a result, the plunger 17 is abruptly moved downwardly by the elastic force of the compression coils 18 and 19 to cause the front end of the staple driver 20 to shot the staple downwardly through the shot outlet 2*b*. The plunger 17 thus moved downwardly is stopped striking against a bumper 22 provided on the bottom of the cylinder member 6. In this operation, the bumper 22 serves as a shock absorber.

A guide hole 2*c* is provided in front of the staple shot outlet 2*b*. A contact arm 23 is vertically slidably fitted in the guide hole 2*c*. The upper end portion 23*a* of the contact arm 23 is bent rearwards (hereinafter referred to as "a bent portion 23*a*", when applicable). A compression coil spring 24 is interposed between the bent portion 23*a* and the frame 2 to urge the contact arm 23 downwardly so that the latter 23 is protruded outside through the guide hole 2*c*. A contact detecting switch 25 is provided behind the bent portion 23*a* of the contact arm 23 so that the lower end portion of the contact arm 23, when retracted into the guide hole 2*c*, turns on the contact detecting switch 25; that is, the contact of the shot outlet 2*b* with an object to be stapled is detected.

A circuit board 26*a*, on which a control circuit 26 is mounted, is arranged in the lower portion of the rear part of the frame 2. A mode change-over switch 28 (not shown in FIG. 1) for selecting a single cycle operation mode or a continuous operation mode is located before the circuit board 26*a* in such a manner that it appears in the side of the frame 2. A battery accommodating section 2*d* is provided above the circuit board 26*a*, in which a chargeable battery pack 27 is loaded.

Figure 2:
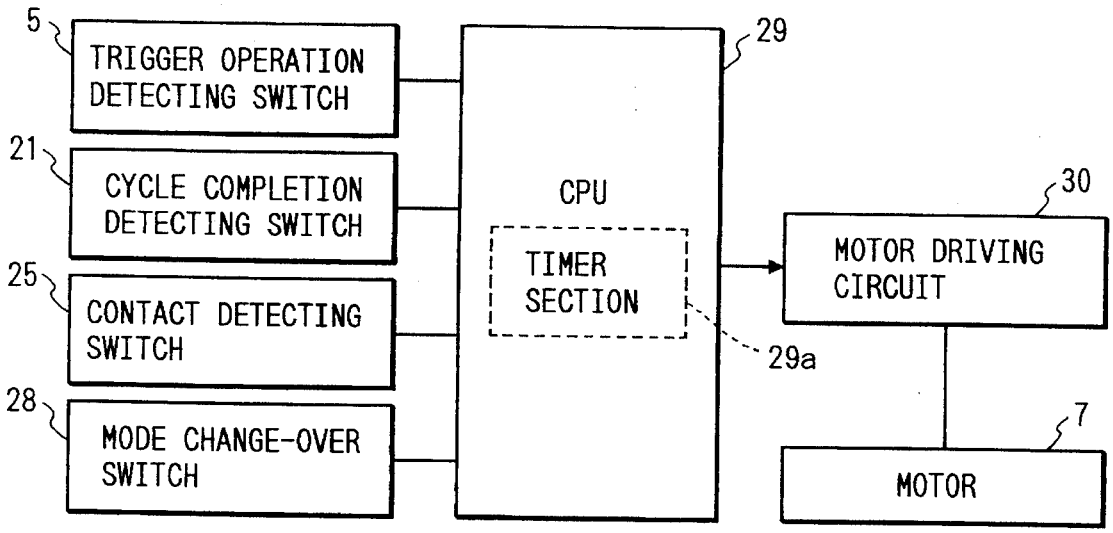
FIG. 2 is a block diagram showing an electrical drive circuit in the staple machine according to the invention.
Figure 3:
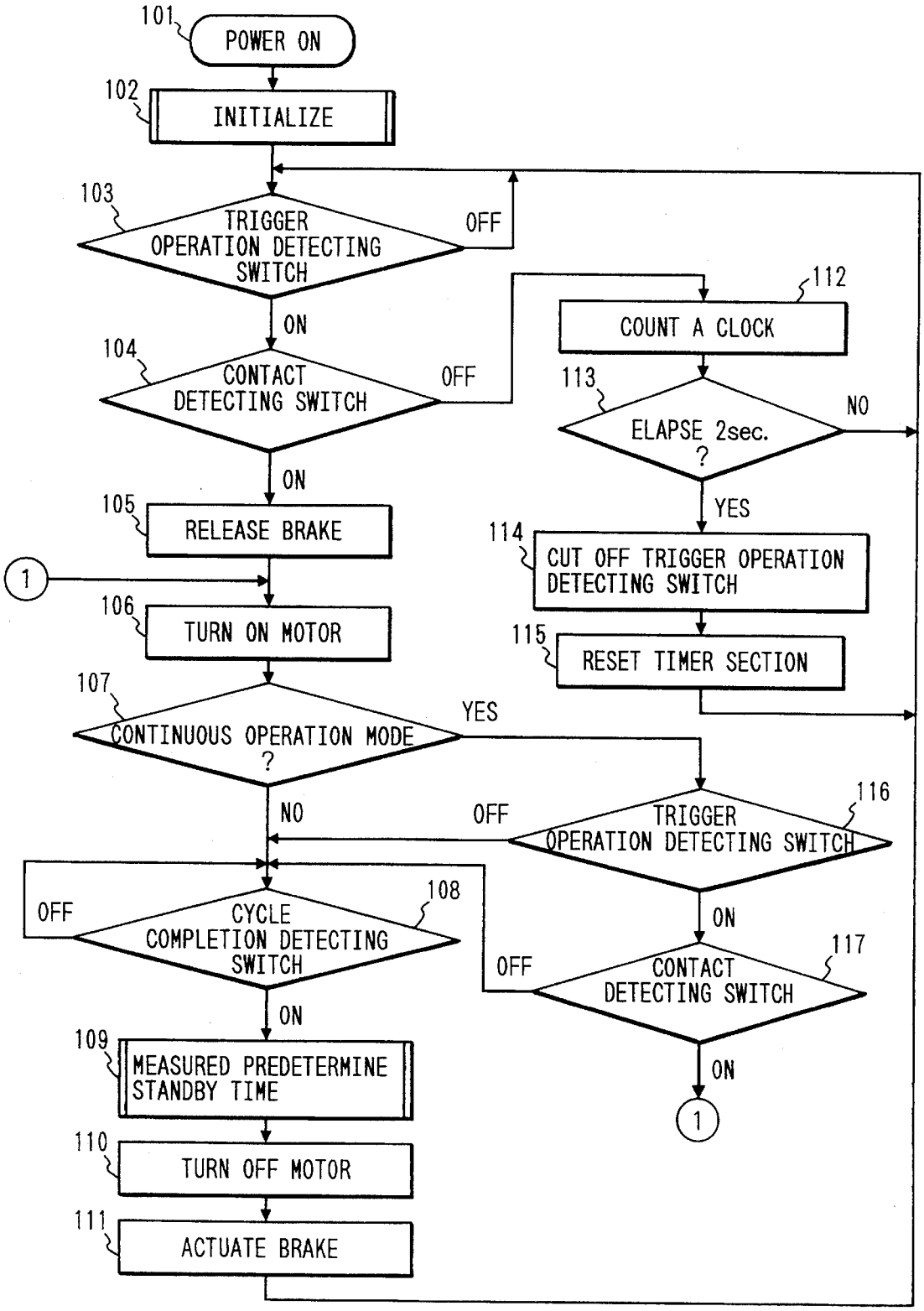
FIG. 3 is a flow chart for a description of the operation of the staple machine according to the invention.

FIG. 2 is a block diagram showing a drive circuit in the portable motor-driven staple machine. The above-described trigger operation detecting switch 5, cycle completion detecting switch 21, contact detecting switch 25, and mode change-over switch 28 are connected to a CPU (central processing unit) 29 in the control circuit 26. The CPU 29 having a timer section 29*a* controls a motor drive circuit 30 according to the states of those switches 5, 21, 25 and 28.

The operation of the portable motor-driven staple machine thus organized will be described with reference to a flow chart of FIG. 3.

When the main switch (not shown) is turned on (Step 101), the CPU 29 is initialized, so that a predetermined program is loaded therein (Step 102).

Under this condition, the staple machine is held in standby state until the trigger lever 3 is operated (Step 103). When the operation of the trigger lever 3 is detected, Step 104 is effected; that is, it is determined whether or not the contact arm 23 is pushed inwardly. When the contact arm 23 is pushed inwardly to turn on the contact detecting switch 25, the electromagnetic brake of the motor 7 is released (Step 105), and the motor 7 is started (Step 106), so that the plunger 17 at the upper standby position is released to drive a staple into the given object.

Thereafter, the position of the mode change-over switch 28 is read (Step 107). When the position of the mode change-over switch 28 indicates that the staple machine is in the single cycle operation mode, the fact that the plunger 17 has been raised to a predetermined position after driving the staple is detected by the cycle completion detecting switch 21 in Step 108, and the lapse of a predetermine standby time from the detection of the arrival of the plunger 17 to the predetermined position is measured (Step 109). Then the motor drive current is cut off (Step 110), and the brakes of the motor 7 are actuated (Step 111). Thereafter, Step 103 is effected again, and the staple machine is placed in standby state for the following trigger operation.

On the other hand, in the case where the contact detecting switch 25 is in "off" state in Step 104; that is, although the trigger lever 3 has been operated, the shot outlet **2*b* is not in contact with the object to be stapled, the timer section 29*a* in the CPU 29 starts counting clock pulses (Step 112), and it is determined whether or not the same condition is kept for the predetermined period, for instance, two (2) seconds (Step 113). When it is determined that the same condition is kept for two seconds, Step 114 is effected to cut off the switch "on" signal of the trigger operation detecting switch 5, and the count value of the timer section 29*a* is reset (Step 115), and Step 103** is effected again.

In the case where the trigger lever 3 is released before the timer section **29*a* measures two seconds in Step 113, Step 103 is effected so that the staple machine is placed in standby state. On the other hand, when the contact arm 23 is pushed against the object before a lapse of two seconds, Steps 113, 103, 104 and 105** are effected in the stated order, to drive the staple.

The portable motor-driven staple machine, being designed as described above, is free from the difficulty that, for instance when the staple machine is moved place to place, the contact arm 23 is carelessly pushed, for instance, against a human body with the trigger lever 3 pulled, so that the staple is driven thereinto.

In the case where, with the continuous operation mode selected by the mode change-over switch 28, the motor 7 is started in Step 106; Steps 107, 116 and 117 are effected in the stated order. The motor 7 is continuously operated as long as both the trigger lever 3 and the contact arm 23 are in active state, so that staples are continuously driven into the object.

When the trigger lever 3 is released (not in active state), Step 116 is switched over to Step 108, so that at the end of the present operation cycle, the motor 7 is stopped, and the staple machine is placed in standby state. When the staple machine is moved away from the object, the contact detecting switch 25 is turned off, so that Step 117 is switched over to Step 108. Therefore, after the present operation cycle is ended, Step 103 is effected; that is, the staple machine is placed in standby state.

As is apparent from the above description, staples can be continuously driven into a given object by operating the mode change-over switch 28; that is, it is unnecessary to operate the trigger lever 3 every operation cycle. Thus, with the staple machine, the staple driving operation can be achieved with high efficiency.

While the preferred embodiment of the invention has been described, it should be noted that the invention is not limited thereto or thereby; for instance the microcomputer in the control section may be replaced with other logical circuits.

The portable motor-driven staple machine of the invention operates as follows: When, although the trigger lever has been operated, the shot outlet is not in contact with an object to be stapled, the timer means starts its counting operation. When, in this case, it is detected that the shot outlet is not brought into contact with the object for the predetermined reference time, the trigger signal is cut off. Hence, the staple machine is free from the difficulty that staples are discharged when the shot outlet contacts a human body or others for instance while the staple machine is being moved by the operator. However, by bringing the shot outlet is into contact with an object within the predetermined reference time with the trigger lever operated, the staple can be driven into the object. That is, the staple machine is improved in safety without adversely affecting an ordinary stapling operation.

The potable motor-driven staple machine of the invention has the function of selecting the single cycle operation mode or the continuous operation mode. When the single cycle operation mode is selected, the staple machine operates as follows: When the trigger lever is operated with the shot outlet pushed against an object to be stapled, staples are continuously driven into the object until the trigger lever is released or the staple machine is moved away from the object. Thus, with the staple machine of the invention, unlike the conventional one, it is unnecessary to operate the trigger lever for every staple when it is required to drive staples continuously. That is, the staple machine of the invention is much higher in operating performance than the conventional staple machine.

What is claimed is:

1. A portable motor-driven staple machine for driving a staple into an object, said portable motor-driven staple machine comprising:

a staple shot outlet;

a detection section for detecting the contact of said staple shot outlet with the object;

a trigger lever;

an electric actuator operated to discharge the staple;

one of a mechanical safety mechanism and an AND circuit allowing said electric actuator to discharge the staple when said staple shot outlet contacts the object and when said trigger lever is operated;

a timer for starting a time measuring operation when said trigger lever is operated while said staple shot outlet is not in contact with the object;

means for comparing a predetermined reference time period with a time period measured by said timer;

means for cutting off a switch "on" signal of said trigger lever and resetting said measured value of said timer when the time period measured by said timer reaches said predetermined reference time period;

an automatic power interrupting means for interrupting the application of power to said electric actuator every operation cycle thereof;

means for controlling said automatic power interrupting means; and a mode change-over switch for selecting a single cycle operation mode or a continuous operation mode, wherein said automatic power interrupting means disabled by operating said mode change-over switch.

2. A portable motor-driven staple machine as recited by claim 1, wherein the controller includes one of a mechanical safety mechanism and an AND circuit, the controller allowing the electric actuator to discharge the staple when the staple shot output contacts the object and the trigger lever is operated.

3. A portable motor-driven staple machine, the portable motor-driven staple machine comprising:

an electric actuator;

automatic power interrupting means for interrupting the application of power to the electric actuator every operation cycle thereof;

means for controlling the automatic power interrupting means; and a mode change-over switch for selecting a single cycle operation mode or a continuous operation mode, wherein the automatic power interrupting means is disabled when the mode changeover switch selects the continuous operation mode.

4. A portable motor-driven staple machine having an automatic power interrupting function for interrupting the application of power to an electric actuator every operation cycle thereof, comprising:

means for controlling the automatic power interrupting function; and a mode change-over switch for selecting a single cycle operation mode or a continuous operation mode, the automatic power interrupting function being disabled when the mode change-over switch selects the continuous operation mode.

* * * * *